US005940092A

United States Patent [19]

Kashimura et al.

[11] Patent Number: 5,940,092

[45] Date of Patent: Aug. 17, 1999

[54] PRINTING APPARATUS AND METHOD

[75] Inventors: Makoto Kashimura; Shigeyoshi Onoda; Haruo Uchida, all of Yokohama; Kazuo Ohyama, Mitaka, all of Japan

[73] Assignee: Canon Kabushiki Kaisha, Tokyo, Japan

[21] Appl. No.: 08/771,307

[22] Filed: Dec. 20, 1996

[30] Foreign Application Priority Data

Dec. 26, 1995 [JP] Japan ..... 4-339293
Dec. 10, 1996 [JP] Japan ..... 8-329714

[51] Int. Cl.[6] ..... B41J 11/20

[52] U.S. Cl. ..... 347/8; 400/55; 400/56

[58] Field of Search ..... 347/8, 37, 104; 400/55, 23, 35, 56

[56] References Cited

U.S. PATENT DOCUMENTS 4,620,807 11/1986 Polit .
5,274,399 12/1993 Uchida et al. ..... 346/134

*Primary Examiner*—N. Le
*Assistant Examiner*—Anh T. N. Vo
*Attorney, Agent, or Firm*—Fitzpatrick, Cella, Harper & Scinto

[57] ABSTRACT

A printing apparatus and method can maintain an appropriate spacing between a print head and the overall printing surface of printing media of a wide range of thicknesses, with a platen mechanism that allows the printing medium to move in parallel displacement, namely both in a direction downstream along the advance of the printing medium and in a direction away from the print head.

14 Claims, 14 Drawing Sheets

PRINTING APPARATUS AND METHOD

BACKGROUND OF THE INVENTION

1. Field of the Invention

The present invention relates to a printing apparatus and method for performing printing with an optimum spacing maintained between the surface of a printing medium and a print head.

2. Description of the Related Art

Printing apparatuses print information such as characters and images on a printing medium such as a sheet of paper, fabric or a plastic sheet. An ink jet printing method, as a nonimpact type printing method, projects ink droplets onto the surface of a printing medium through ink nozzles, permitting high-density and high-speed printing. For these advantages, the ink jet printing method is widely used in printing apparatus of a diversity of pieces of office equipment including printers, photocopying machines, facsimile machines, and wordprocessors.

The-printing apparatus that uses such a ink-jet printing method needs to keep constant the spacing between the printing surface of a printing medium and an ink jet print hand to form an optimum image on the printing surface. With an ink-jet head held to the printing surface of a printing medium with too narrow spacing therebetween, the ink-jet head may contact the printing surface of the medium, smearing the printing surface, or the head itself is possibly damaged. When the spacing between the ink-jet print head and the printing surface of the medium is too wide, the image quality may be degraded.

The printing media used in the ink-jet printing apparatuses include not only particular types of paper, but a diversity of media including envelopes, postcards, overhead projector sheets, and fabrics. As the types of printing media vary, their thicknesses vary accordingly, and the spacings between the printing surfaces of the printing media and the ink-jet print head also vary. As a result, the printing surface of the medium is smeared, the ink-jet head is damaged, and the resulting image quality suffers degradation.

In an attempt to preclude these problems, the ink-jet print head is shifted in accordance with the thickness of the printing medium using a lever to maintain an appropriate spacing between the printing surface of the printing medium and the ink-jet print head. The handling of the lever is a clumsy and delicate operation, and is not a satisfactory solution.

One method of keeping constant the spacing between the printing surface of a medium and an ink-jet head regardless of the thickness of the medium has been proposed in Japanese Unexamined Patent Publication No. 7-81047. According to this disclosure, a pair of driven rollers for advancing a printing medium is disposed on the side of an ink-jet print head that faces a platen with the printing medium being interposed between the platen and the ink-jet print head. The platen is urged toward the rollers so that the position of the printing surface of the printing medium remains fixed relative to the ink-jet print head regardless of the thickness of the medium.

FIG. 14 shows the construction of the major portion of such a known printing apparatus. As shown, an ink-jet print head 103 faces a platen 102 with a printing medium 101 interposed therebetween. The ink-jet print head 103 is mounted on a carriage 105 that slidably reciprocates along a guide rail 104, and thus prints a desired image onto the printing surface of the printing medium 101. A pair of transport rollers 107, 108 are arranged upstream of and downstream of the ink-jet print head 103 along the advance of the printing medium 101 that is moved from left to right in FIG. 14. The transport rollers 107, 108 are pressed into contact with the printing surface 106 of the printing medium 101 in a manner that the transport rollers 107, 108 are rotatable in their driving direction. A pair of pinch rollers 109, 110 that are rotatable supported are pressed into contact with the printing medium 101 against the transport rollers 107, 108. The pinch rollers 109, 110 along with the platen 102 are pressed toward the ink-jet print head 103 with the urging of pressure springs 111. As the transport rollers 107, 108 rotate to advance the printing medium 101, the pinch rollers 109, 110 run freely along therewith. The pinch rollers 109, 110 along with the platen 102 are displaced in the direction toward the transport rollers 107, 108 to keep constant the spacing between the ink-jet print head 103 and the printing surface 106 of the printing medium 101.

U.S. Pat. No. 4,620,807 discloses a wire printer 5 for printing on envelopes 12 of a wide range of thicknesses. In the disclosure, a platen 10 is displaced vertically downwardly by a link mechanism 36, 37 and 40 and a slide mechanism 51, 58 in accordance with the thickness of an envelope that is transported in a horizontal direction.

In the known ink-jet printing apparatus shown in FIG. 14, there are times when the printing medium 101 is caught between the upstream transport roller 107 and the pinch roller 109 with the forward edge of the printing medium 101 yet to reach the nip between the downstream transport roller 108 and the pinch roller 110. There are also times when the printing medium 101 is caught between the downstream transport roller 108 and the pinch roller 110 with the back edge of the printing medium 101 already parted from the nip between the upstream transport roller 107 and the pinch roller 109. In such conditions, depending on its thickness, the printing medium 101 is slightly tilted with respect to the ink-jet print head 103, and thus the spacing between the ink-jet print head 103 and the printing surface 106 cannot be kept constant.

The downstream transport roller 108 has on its circumference a spur-gear-like thin sheet with serrations to minimize contact with freshly printed ink on the printing medium 106. The pinch roller 110 displaces against the urging of the pressure spring 111, and therefore, the downstream transport roller 108 results in no sufficient friction with the printing surface 106. In the region where the printing medium 101 is advanced only by the nip between the downstream transport roller 108 and the pinch roller 110, the advance accuracy of the printing medium 101 may be degraded.

In the recording apparatus disclosed in U.S. Pat. No. 4,620,807, when a recording medium, a thin one in particular, comes into a recording area, the downstream side of the recording medium fails to shift in a vertical direction and the platen is subject to a tilt, because of looseness in mounts of links in the link mechanism. Furthermore, the use of the link mechanism makes area inevitably bulky the structure of the recording area.

SUMMARY OF THE INVENTION

It is an object of the present invention to provide a printing apparatus and method that permit excellent quality printing by maintaining an appropriate spacing between the entire printing surface of a printing medium and a print head and by maintaining the advance accuracy of the printing medium.

It is another object of the present invention to provide a printing apparatus and method that maintain an appropriate spacing between the printing surface and the print head by displacing the entire printing surface of the printing medium in parallel displacement, namely downstream along the advance of the printing medium and also in the direction away from the print head in accordance with the thickness of the printing medium with parallelism kept to the print head.

To achieve the above objects, the printing apparatus for printing on the printing surface of a printing medium placed on a printing position with a print head, according to the present invention, comprises a platen mounted in a position facing the print head, for supporting the printing medium from the back surface of the printing medium opposite the printing surface, a transport mechanism for advancing the printing medium to the position where the platen faces the print head and for delivering the printing medium out of the position where the platen faces the print head, a medium positioning member disposed upstream of the printing medium placed on the printing position along the advance of the printing medium in a manner that the medium positioning member contacts the printing surface of the printing medium, a mechanism for supporting the platen so that the platen is displaced in parallel displacement, namely downstream along the advance of the printing medium and in the direction that the platen parts from the print head, and an urging for urging in the direction opposite to the direction of displacement of the platen displaced by the support mechanism in order to press the platen against the medium positioning member.

DESCRIPTION OF THE PREFERRED EMBODIMENTS

Figure 1:
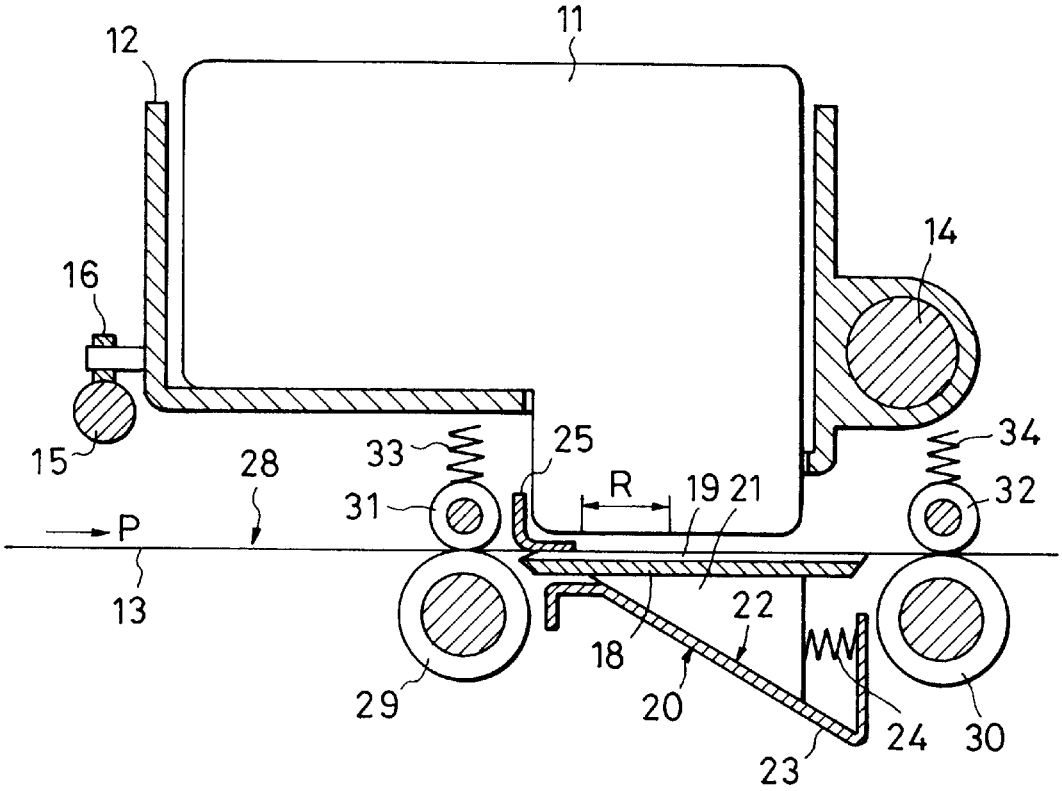
FIG. 1 is a diagrammatic cross-sectional view showing the construction of the major portion of an embodiment 1 of the present invention, in which the printing apparatus of the present invention is incorporated in an ink-jet printer.

Referring now to the drawings, the embodiments of the present invention are discussed. In each of the embodiments, the printing apparatus of the present invention is incorporated in an ink-jet printer. The present invention can be incorporated not only in the ink-jet printer but also in a wide range of devices that prints on a printing medium with ink. In each of the figures, P represents the direction of advance of the printing medium, and R represents the area of an array of ink nozzles, namely a printing area.

Figure 2:
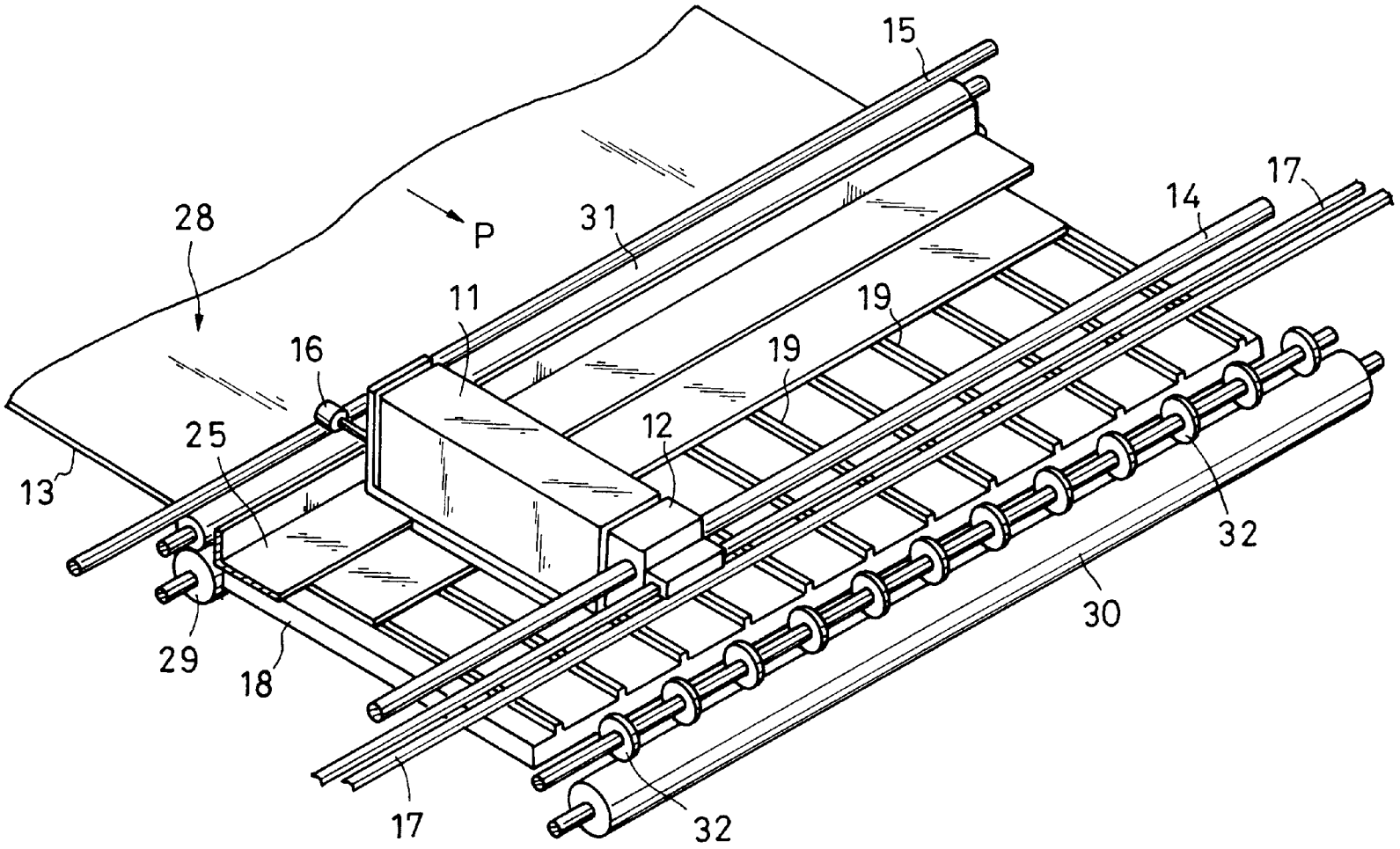
FIG. 2 is a fragmentary perspective view showing the appearance of the major portion according to the embodiment 1 of the present invention.

FIGS. 1 and 2 are the diagrammatic cross-sectional view and the fragmentary perspective view shoving the construction of the major portion of the embodiment 1 of the present invention. A guide rail 14 extends in the direction of width of a printing medium 13. The guide rail 14 passes through a carriage 12 to slidably support it in its front portion (downstream along the advance of the printing medium). An ink-jet print head 11 is detachably mounted on the carriage 12. On its rear portion (upstream along the advance of the printing medium), the carriage 12 rotatably supports a guide roller 16 that rolls on a support rail 15 extending in parallel with the guide rail 14. The carriage 12 is, on its front portion, engaged with a timing belt 17 that is entrained about a pair of right and left cog pulleys (unshown) that are rotatable in both normal and reverse directions by an unshown carriages driving motor. As the timing belt 17 moves, the carriage 12 along with the ink-jet print head 11 scans along the guide rail 14 in a direction different from the direction of advance of the printing medium, for example, in the direction of width of the printing medium 13.

The ink-jet print head 11 ha unshown nozzles for projecting droplets of ink, and unshown electrothermal converter elements disposed inside pipes communicating with the respective nozzles, for generating thermal energy for propelling ink out. A platen 18 faces the ink-jet print head 11 and extends in the direction of scan of the ink-jet print head 11. A plurality of ribs 19 are projected from the surface of the platen 18 facing the ink-jet print head 11. The plurality of ribs 19 are spaced apart at predetermined intervals over across the width of the printing medium 13 and run in the direction of the advance of the printing medium 13 (namely, in the direction from left to right in FIG. 1). The platen 18 on its underside has integrally a movable guide plate 21 having an inclined guide surface 20. The inclined guide surface 20 is inclined so that it parts farther from the ink-jet print head 11 as the printing medium 13 runs downstream in its direction of advance. Disposed right below the platen 18 is a platen support plate 23 having an inclined guide surface 22 that coincides, in inclination, with the inclined guide surface 20 of the movable guide plate 21. The angle of inclination of the inclined guide surface 20 is 15 degrees or greater but 60 degrees or smaller with respect to the support surface of the platen 18 for the printing medium 13. Preferably, the angle of inclination of the inclined guide surface 20 is 25 degrees or greater but 40 degrees or smaller, and is 30 degrees in this embodiment.

In this embodiment, the plurality of ribs 19 are formed on the surface of the platen 18 to reduce friction between the platen 18 and the printing medium 13. If such friction is negligibly small, the platen 18 may be flat without ribs 19.

The platen 18 is connected to the platen support plate 23 so that the movable guide plate 21 attached to the underside of the platen 18 slides on its inclined guide surface 20 against the inclined guide surface 22 to vary the spacing to the ink-jet print head 11. A compression spring 24 is interposed between the movable guide plate 21 and the platen support plate 23 to urge the platen 18 toward the ink-jet print head 11. When the printing medium 13 is a typical recording paper such as a roll of paper and cut sheet, or a resin sheet, the compression spring 24 urges the movable guide plate 21 along the inclined guide surfaces 20, 22, preferably at a force of 3 grams or greater but 20 grams or smaller, and more preferably at a force of 5 grams or greater but 9 grams or smaller. The magnitude of urging, particularly, its upper limit, is subject to modification, depending on the weight of the printing medium to be printed.

Disposed right above the back edge (upstream along the advance of the printing medium 13) of the platen 18 is an L-shaped medium positioning plate 25 that extends in parallel with the guide rail 14, facing the ribs 19 on the backward edge of the platen 18. The underside of the positioning plate 25 as the medium positioning means placed upstream along the advance of the printing medium is pressed onto the printing surface 28 of the printing medium 13 by the platen 18. The platen 18 is urged toward the ink-jet print head 11 by the compression spring 24 as an elastic member, along the inclined guide surfaces 20, 22. Regardless of the thickness of the printing medium 13, an appropriate spacing is maintained between the printing surface 28 of the printing medium 13 and the ink-jet print head 11.

The platen 18 is constructed of a material such as polyphenylene oxide characteristic of a good ink-resistivity or polyacetal characteristic of low friction. The platen support plate 23 is constructed of a zinc-coated steel sheet, and the medium positioning plate 25 is of a stainless steel sheet.

A pair of transport rollers 29, 30 are arranged along the advance of the printing medium 13, respectively, upstream of the medium positioning plate 25 and downstream of the forward edge of the platen 8 (namely, downstream along the advance of the printing medium 13). The pair of transport rollers 29, 30 in parallel with the guide rail 14 and resin in contact with the back surface of the printing medium 13 opposite its printing surface 28. The pair of transport rollers 29, 30 are driven by an unshown driving motor. A pair of pinch rollers 31, 32 facing the pair of transport rollers 29, 30 with the printing medium 13 interposed therebetween are urged, respectively, toward the transport rollers 29, 30 by pressure springs 33, 34. The pinch roller 32 downstream of the printing medium 13 has a spur-gear like outer circumference with a plurality of projections.

The printing surface 28 of the printing medium 13 is pressed between the medium positioning plate 25 and the platen 18 and the spacing between the printing surface 28 of the printing medium 13 and the ink-jet print head 11 is kept to a predetermined distance. When a printing medium 13 of a different thickness is introduced, the platen 18 moves downstream along the advance of the printing medium while parting away from the ink-jet print head 11 to accommodate a change in thickness of the printing medium 13. The inclined guide surfaces 20, 22 are configured such that they part away from the print head as the printing medium 13 runs downstream in the direction of advance. The printing medium 13 slides along the platen 18 with a predetermined advance accuracy maintained and without affecting printing quality, while the platen 18 is slides downward along the inclined guide surfaces 20, 22 against the urging of the compression spring 24 (in the direction away from the print head). Thus, an appropriate spacing between the printing surface 28 and the ink-jet print head 11 is maintained.

As shown in FIG. 1, an edge of the ink nozzle array of the print head is placed in the vicinity of the downstream edge of the medium positioning plate 25. A position where ink droplets projected from ink nozzles are deposited is defined as the printing position. The ink nozzle array faces the printing position. As shown in FIG. 1, image printing is continuously performed on the printing medium 13 immediately before the backward edge of the printing medium 13 is just clear of the medium positioning plate 25. Since the axes of rotation of the upstream transport roller 29 and downstream transport roller 30 are fixed, advance accuracy of the printing medium 13 is well maintained, when the printing medium 13 is advanced by the upstream transport roller 29 and the pinch roller 31 or when the printing medium 13 is advanced by the downstream transport roller 30 and the pinch roller 32.

A medium position roller 26 to be described in connection with the embodiment 3 may be arranged facing the downstream side of the platen 18 along the advance of the printing medium 13 with respect to the ink-jet print head 11. The medium positioning roller 26 may be designed to rotate in synchronism with the transport rollers 29, 30. In this way, the advantage of this embodiment is even more enhanced.

Figure 3:
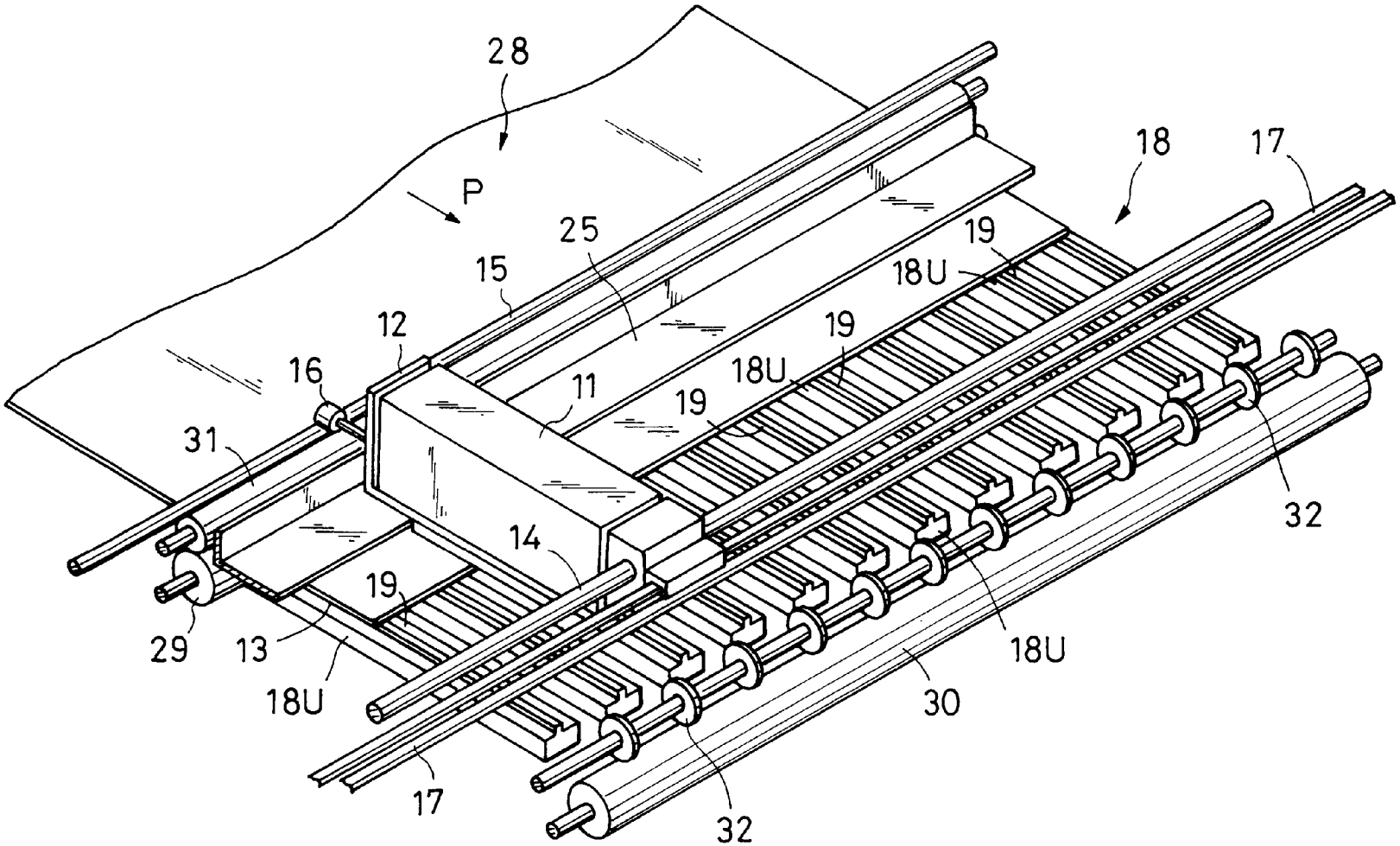
FIG. 3 is a fragmentary perspective view showing the appearance of the major portion according to the embodiment 2 of the print invention.

The embodiment 2 of the present invention is now discussed. FIG. 3 shows the fragmentary respective view showing the appearance of the major portion of the embodiment 2. In FIG. 3, components equivalent or identical to those described in connection with the embodiment 1 are designated with the same reference numerals, and their description is not repeated.

In the embodiment 2, the platen 18 in the embodiment 1 is split into a plurality of units along the direction different from the direction of advance of the printing medium 13, for example, a plurality of units extending in the direction of the advance of the printing medium 13 are spaced across the width of the printing medium 13.

The platen 18 in this embodiment is made up of a number of platen units 18U, having a projected rib 19. The platen units 18U are equally spaced across the width of the printing medium 13. Each platen unit 18U has a similar construction to that of the platen 18 in the preceding embodiment, namely each platen unit 18U has a movable guide plate 21 and a compression spring 24 (FIG. 1).

Since each platen unit 18U is pressed by the medium positioning plate 25, the printing surface 28 of the printing medium 13 is reliably put into contact with the medium positioning plate 25 regardless of the width of the printing medium 13. Since each platen unit 18U is urged toward the ink-jet print head 11 by the respective compression spring 24, the printing medium 13 is uniformly pressed against the medium positioning plate 25 across its width, and the printing medium 13 is prevented from skewing in its advance.

In this embodiment, each platen unit 18U has its own compression spring 24. The same advantage is expected even if all platen units 18U share commonly a single compression spring 24.

Furthermore, a medium position roller 26 to be described in connection with the embodiment 3 may be arranged facing the downstream side of the platen 18. The medium positioning roller 26 may be designed to rotate in synchronism with the transport rollers 29, 30. In ths way, the advantage of this embodiment is even more enhanced. In this embodiment, the printing medium 13 is prevented from curling or wrinkling when its ford edge reaches the nip between the downstream transport roller 30 and the pinch roller 32. The spacing bet the printing surface 28 of the printing medium 13 and the ink-jet print head 11 is reliably maintained at an appropriate distance. If a cylindrical cleaning member that rotates with its circumference in contact with the medium positioning roller 26 and the downstream pinch roller 32 is supported in a pivotally Arable fashion, and if the circumferential speeds of the medium positioning roller 26 and the downstream pinch roller 32 are equalized, the printing medium 13 is prevented from curling or wrinkling when its forward edge enters the nip between the downstream transport roller 30 and the pinch roller 32. The cleaning member removes ink sticking to the circumferences of the medium positioning roller 36 and the downstream pinch roller 32, thereby preventing a printed image on the printing surface 28 of the printing medium 13 from smearing.

The embodiment 3 of the present invention is now discussed.

Figure 4:
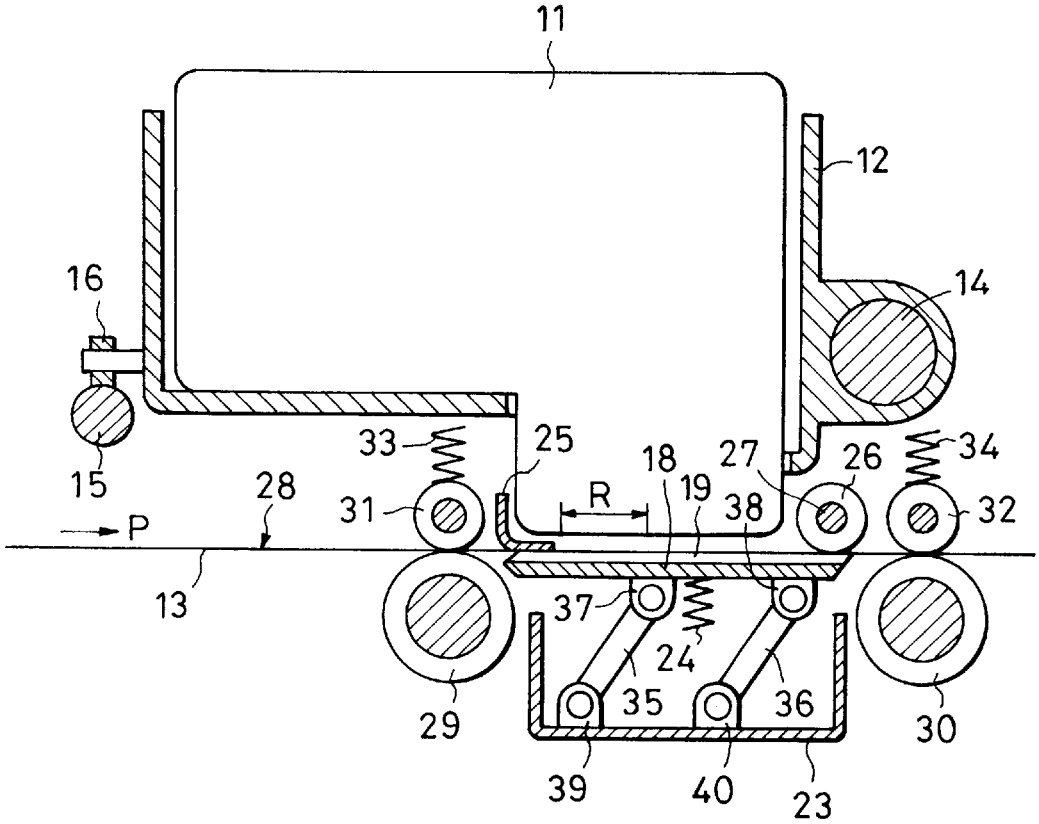
FIG. 4 is a diagrammatic cross-sectional view showing the construction of the major portion of an embodiment 3 of the present invention.

In the two preceding embodiments, the inclined guide surfaces 20, 22 allow the platen 18 to move in parallel displacement, namely both downstream along the advance of the printing medium and downward apart from the print head. Alternatively, a link mechanism may be used to move the platen 18 in parallel displacement. FIG. 4 is the diagruatic cross-sectional view showing the construction of the major portion of the embodiment 3 of the present invention. In FIG. 4, components equivalent or identical to those described with ref e to the preceding embodiments are designated with the same reference numerals, and their discussion is not repeated.

Backward and forward lateral pairs of link brackets 37, 38 are projected from the underside of the platen 18 from its upstream portion and downstream portion, respectively. The link brackets 37, 38 pivotally support respective pairs of links 35, 36 on their top ends. Disposed below the platen 18 is a platen support plate 32 having a tray-like configuration in its vertically longitudinal cross section. Two lateral pairs of link brackets 39, 40, one lateral pair on its upstream portion and the other lateral pair on its downstream portion, are projected from the inner bottom of the platen support plate 32. The link brackets 39, 40 pivotally support the bottom ends of the forward and backward pairs of links 35, 36. The forward and backward links 35, 36 are equal in length The separation between-the forward and backward link brackets 37, 38 on the platen 18 and the separation between the forward and backward link brackets 39, 40 on the platen support plate 23 are set to be equal. A parallelogram or pantograph link mechanism is thus formed by the platen 18, platen support plate 23, and links 35, 36.

A medium position roller 26.is arranged facing the downstream side of the platen 18 along the advance of the printing medium 13 and is rotatably supported by the shaft 27. The medium positioning roller 26 is designed to rotate in synchronism with the transport rollers 29, 30.

The compression spring 24 is interposed between the platen 18 and the platen support plate 23 to urge the platen 18 toward the ink-jet print head 11. The introduction of the printing medium 13 causes the platen 18 to move in parallel displacement, namely vertically away from the ink-jet print head 11 and downstream along the advance of the printing medium.

The embodiment 3 requires components for platen support means compared with the embodiments in FIGS. 1 and 2, and also requires machining accuracy and assembly accuracy of parts of the link mechanism sufficient to allow the platen 18 to move in parallel displacement. The embodiment 3, however, Is free from resistance that takes place between the inclined guide surfaces 20, 22 when the platen 18 and the platen support plate 23 slide against each other, and thus works with the compression spring 24 of a smaller force than those in the preceding embodiments.

Figure 5:
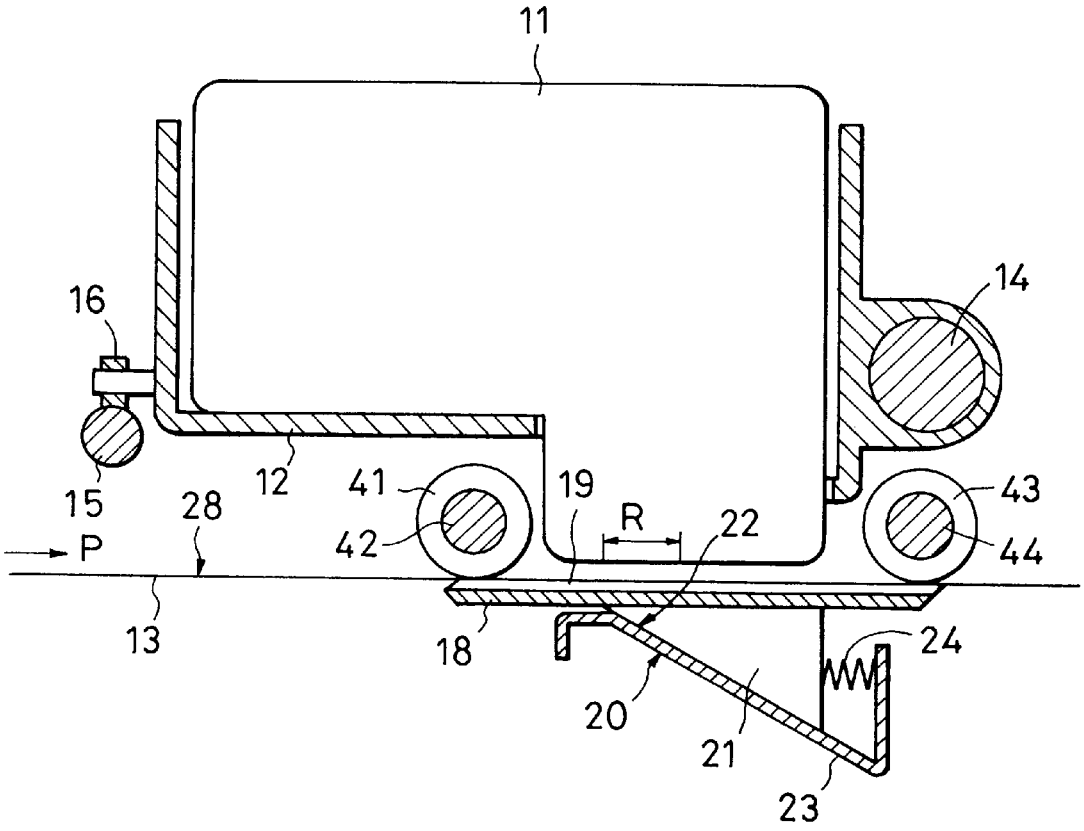
FIG. 5 is a diagrammatic cross-sectional view showing the construction of the major portion of an embodiment 4 of the present invention.

In each of the preceding embodiments, transport means (the transport rollers 29, 30 and pinch rollers 31, 32) for advancing the printing medium 13 and positioning means (the Bus positioning plate 25, the medium positioning roller 26) for positioning the printing surface 28 of the printing medium 13 are separately constructed. The medium positioning roller 26 and its shaft 27 downstream of the ink-jet print head 11 may be dispensed with. The transport deans an the positioning means may be integrated in function. Such an ink-jet printing apparatus is shown in the diagrammatic cross-sectional view in FIG. 5 as the embodiment 4 of the present invention. In FIG. 5, like components are identified with like refer numerals, and their description is not repeated.

Disposed right above the backward edge of the platen 18 (upstream along the advance of the printing medium) is a transport roller 41 in alignment with the rear ends of the ribs 19 on the platen 18, with the printing medium 13 interposed therebetween. The transport roller 41 is rotatably supported about the axis of rotation of a driving shaft 42 that extends an parallel with the guide rail 14. Disposed right above the forward edge of the platen 18 (downstream along the advance of the printing medium) is a transport roller 43 in alignment with the forward ends of the ribs 19 on the platen 18, with the prong medium 13 therebtween. The transport roller 43 is rotatably supported about the axis of rotation of a driving shaft 44 that ends in parallel with the guide rail 14. The platen 18 urged by the compression spring 24 presses the printing surface 28 of the printing medium 13 against the pair of rollers 41, 43 from below. Regardless of the thickness of the printing medium 13, the spacing between the printing surface 28 of the printing medium 13 and the ink-jet print head 11 is constantly maintained appropriate.

The pair of rollers 41, 43 arranged downstream of and upstream of the ink-jet print head 11 along the advance of the printing medium 13 also function as the already-described medium positioning plate 25 and the medium positioning roller 26. Since the downstream transport roller 43 is pressed into contact with the image printed on the printing surface 28 of the printing medium 13, a quick-drying characteristic is required of the ink projected-out of the ink-jet print head 11.

This embodiment dispenses with the medium positioning plate 25, medium positioning roller 26, pinch rollers 31, 32 and springs 33, 34, and requires a fewer components than the preceding embodiments, and permits a compact design. Since the layout of associated comports does not pelt larger diameter transport rollers 41, 43, this embodiment particularly suits ink-jet printing apparatuses for small-size printing media 13 such as postcards.

The embodiment 5 of the present invention is now discussed.

According to embodiments shown in FIGS. 1 through 5, the platen 18 is pushed away from the mum positioning plate 25 against the urging the compression spring 24 as the forward of the printing medium 13 enters between the platen 18 and the medium positioning plate 25. Although the force of the compression spring 24 against the platen 18 is a few grams as already described, the printing medium 13, if thin and limp, is subject to jamming. Thus, it may be advantageous to retract initially the platen 18 in the direction that it parts from the medium positioning plate 25 when the forward edge of the printing medium 13 is enters between the platen 18 and the medium positioning plate 25.

Figure 6:
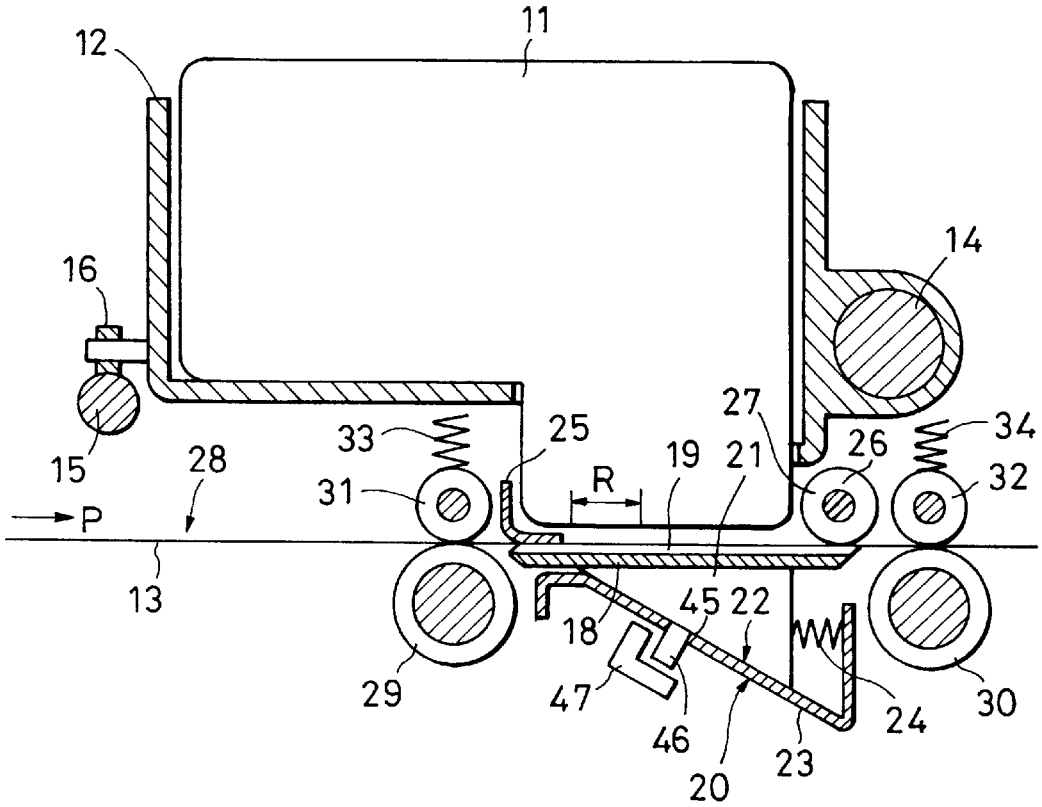
FIG. 6 is a diagrammatic cross-sectional view showing the construction of the major portion of an embodiment 5 of the present invention.

Such an ink-jet printing apparatus is shown in the diagrammatic cross-sectional view in FIG. 6 as the embodiment 5 of the present invention. In FIG. 6, components equivalent or identical to those described in connection with the embodiment 1 in FIGS. 1 and 2 are designated with the same reference numerals, and their description is not repeated.

he inclined guide surface 22 of the platen support plate 23 has a slot 45 that runs in the direction of sliding of the movable guide plate 21. A locking pin 46 that slidably passes through the slot 45 is projected from the inclined guide surface 20 of the movable guide plate 21. A catch 47 facing the locking pin 46 for engaging with the looking pin 46 is conned to an unshown actuator in a Or that allows the catch 47 to reciprocate in the direction of sliding of the movable guide plate 21 along the inclined guide surfaces 20, 21.

In the inactive state of the actuator as on in FIG. 6, the platen 18 under the urging of the compression spring 24 is pressed against the medium positioning plate 25 and the medium positioning roller 26. When the forward edge of the printing medium 13 is introduced into between the platen 18 and the medium positioning plate 25, the actuator is activated to move the catch 47 downwardly rightward in FIG. 6. The locking pin 46 along with the movable guide plate 21 moves against the urging of the compression spring 24, and the platen 18 is retracted away from the medium positioning plate 25. In this case, the stroke of the actuator is preferably set such that the clearance formed between the medium positioning plate 25 and the platen 18 in greater than the thickness of the printing medium 13.

As a result, the forward of the printing medium 13 is introduced into between the transport roller 30 and the pinch roller 32 without a resistance. The actuator turns inactive again at the moment the forward edge of the printing medium 13 advances past the medium positioning roller 26. Under the urging of the compression spring 24, the printing medium 13 is held between the platen 18 and the medium positioning plate 25 or the medium positioning roller 26. Thus, even a thin and limp printing medium 13 is free from jamming.

The embodiment 6 of the present invention is now discussed.

The arrangement in the embodiment 5 may be incorporated in the embodiment 3 shown in FIG. 4.

Figure 7:
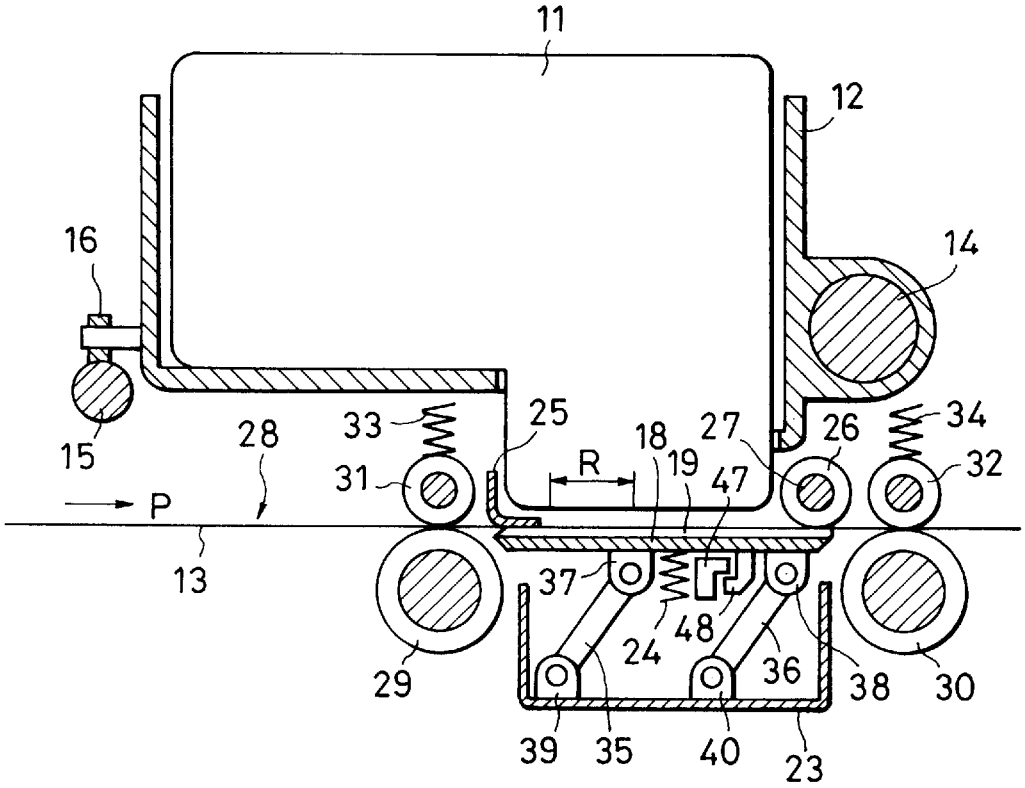
FIG. 7 is a diagrammatic cross-sectional view showing the construction of the major portion of an embodiment 6 of the present invention.

Such an ink-jet printing apparatus is shown in the diagrammatic cross-sectional view in FIG. 7 as the embodiment 6 of the present invention. In FIG. 7, components equivalent or identical to those described in connection with the preceding embodiments are designated with the same reference numerals, and their description is not repeated.

A locking member 48 is projected from the underside of the platen 18. A catch 47 facing the locking member 48 for engaging with the locking member 48 is connected to an unshown actuator in a manner that allows the catch 47 to reciprocate in the direction of movement of the platen 18 that moves integrally with the links 35, 36. In the inactive state of the actuator shown in FIG. 7, the platen 18 under the urging of the compression spring 24 is pressurized against the medium positioning plate 25 and the medium positioning roller 26. The actuator is activated to move the catch 47 downward in FIG. 7 when the forward edge of the printing medium 13 is introduced into between the platen I8 and the medium positioning plate 25. In this way, the locking member 48 along with the platen 18 is retracted away from the medium positioning plate 25 against the urging of the compression spring 24.

AS a result, the forward edge of the printing medium 13 is introduced into between the transport roller 30 and the pinch roller 32 without any resistance and even a thin and limp printing medium 13 is free from jamming.

The embodiment 7 of the present invention is now discussed.

Figure 8:
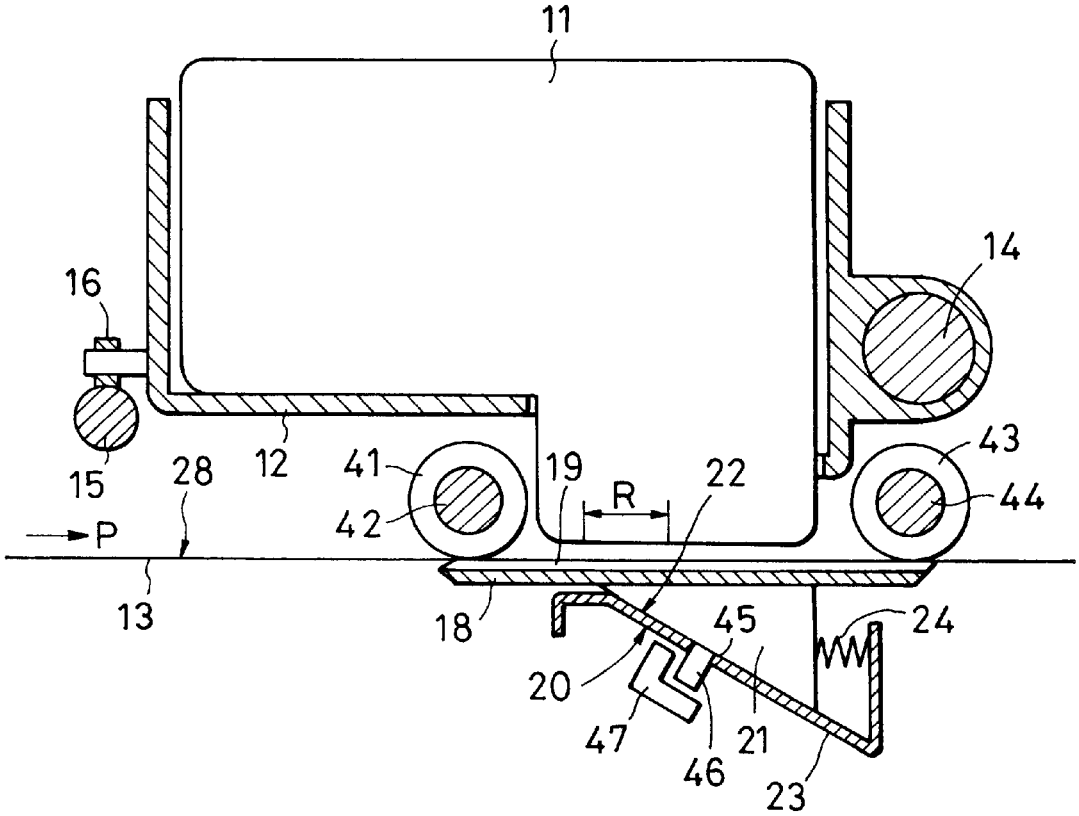
FIG. 8 in a diagrammatic cross-sectional view showing the construction of the major portion of an embodiment 7 of the present invention.

The retraction mechanism shown in FIG. 6 may be incorporated in the embodiment 4 shown in FIG. 5. Such an ink-Jet printing apparatus is shown in the diagrammatic cross-sectional view in FIG. 8 as the embodiment 7 of the present invention. In FIG. 8, components equivalent or identical to those described in connection with the preceding embodiments are designated with the same reference numerals, and their description is not repeated.

In this embodiment, when the forward edge of the printing medium 13 is brought into between the platen 18 and the transport roller 41 by transport rollers (unshown) a e upstream thereof, the actuator is activated to mm the catch 47 downwardly rightward in FIG. 8, and thus the locking pin 46 along with the movable guide plate 21 is against the urging of the compression spring 24. The platen 18 is thus retracted away from the transport roller 41.

As a result, the forward edge of the printing medium 13 is introduced into between the transport roller 41 and the platen 18 without any resistance and even a thin and limp printing medium 13 is free from jamming.

Figure 9:
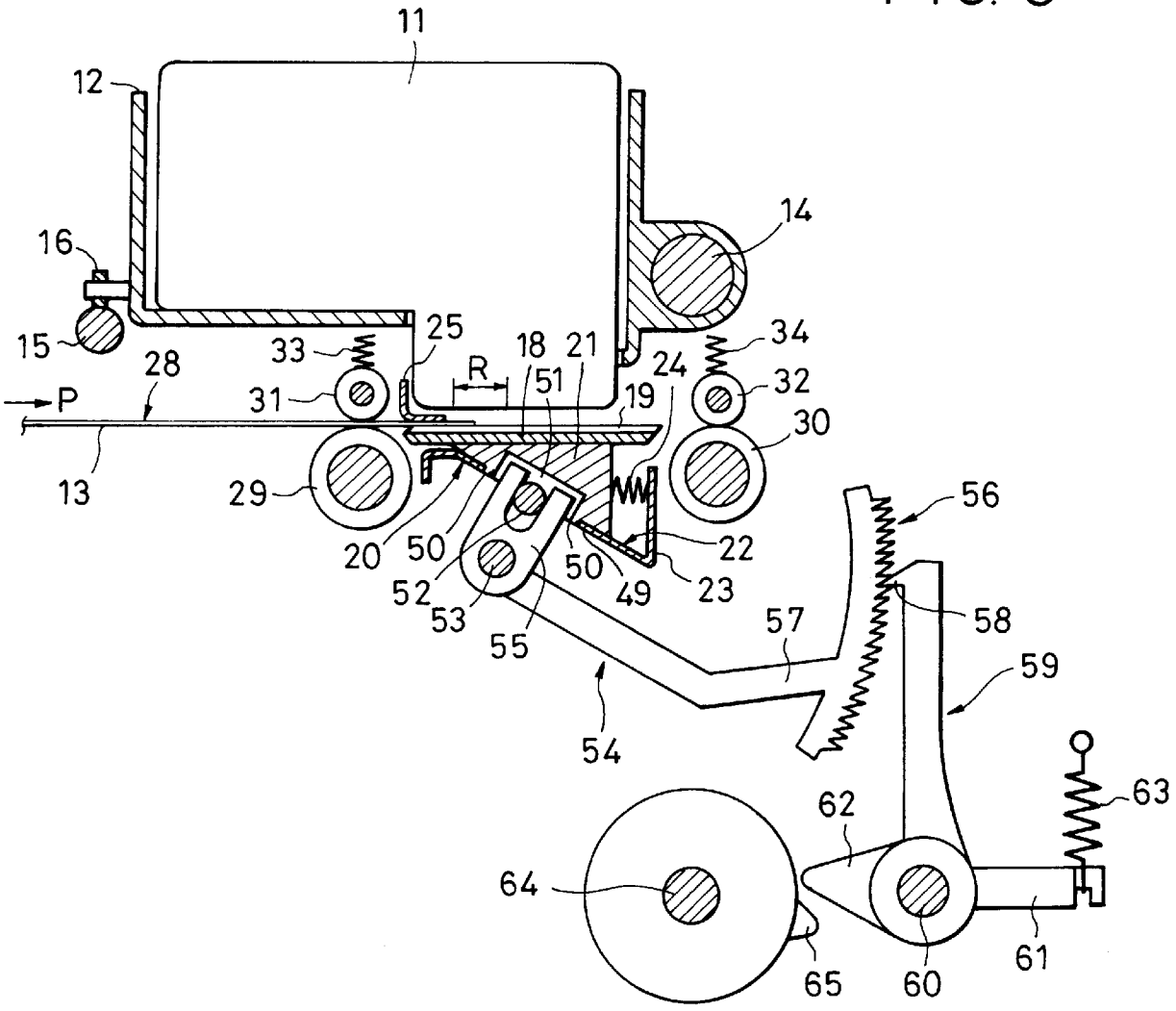
FIG. 9 is a diagrammatic cross-sectional view showing the construction of the major portion of an embodiment 8 of the present invention, with a printing medium entering the printing region.
Figure 10:
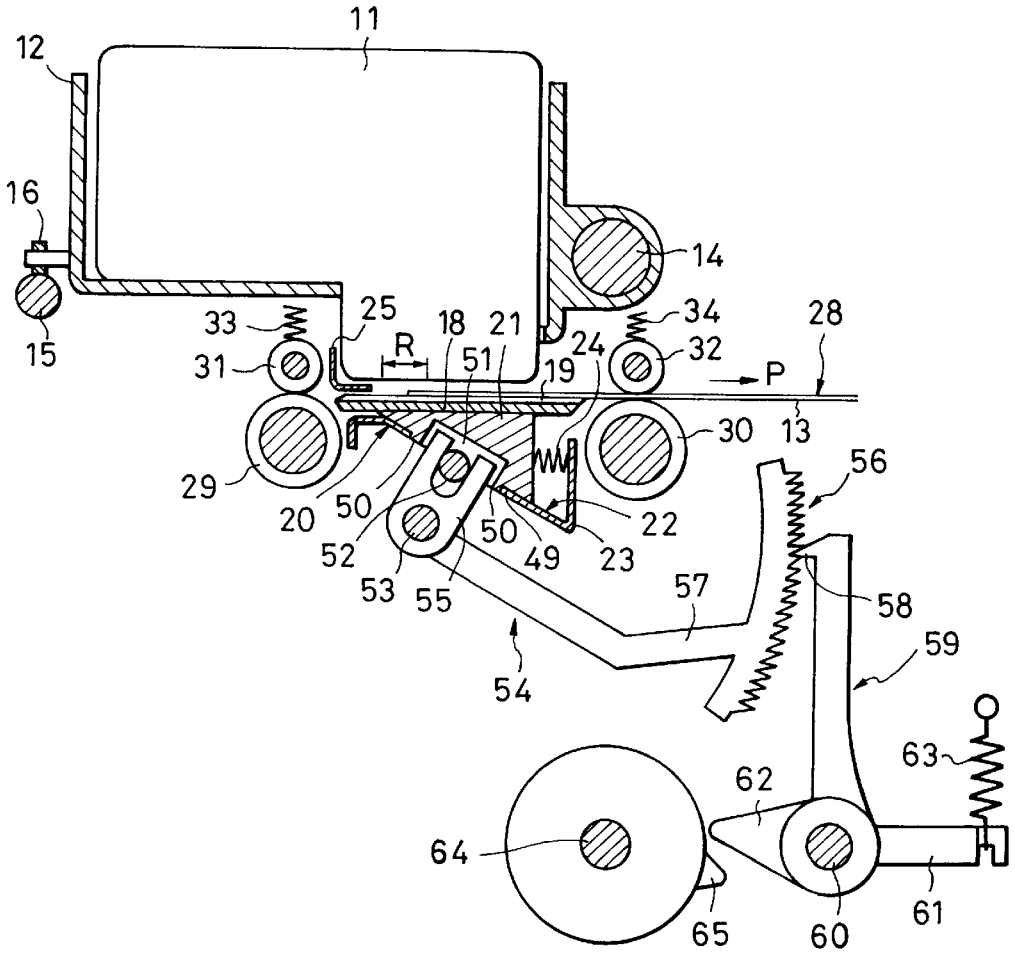
FIG. 10 is a diagrammatic cross-sectional view showing the construction of the major portion of the embodiment 8 of the present invention, with the printing medium exiting the printer region.
Figure 11:
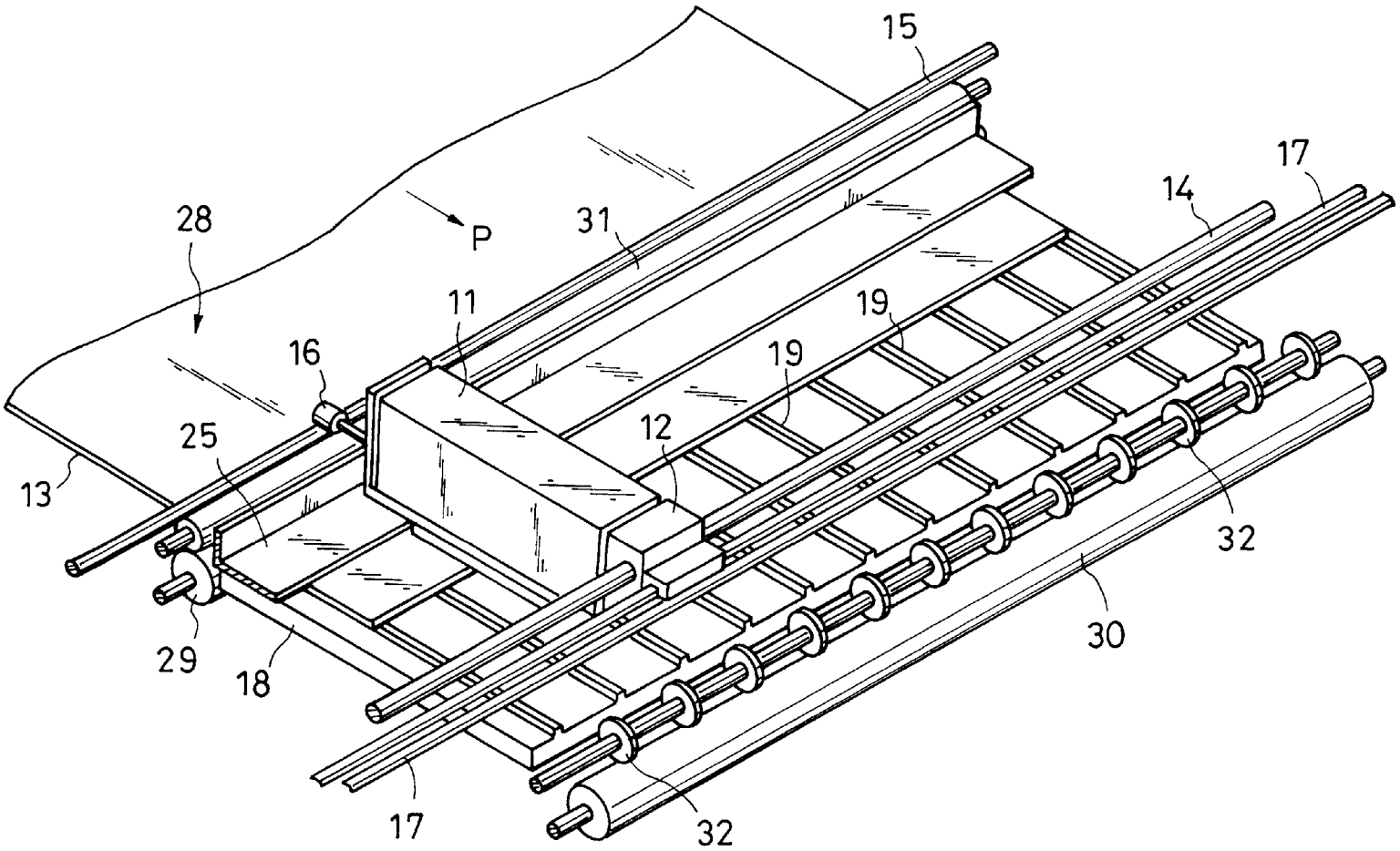
FIG. 11 is a fragmentary perspective view showing the appearance of the major portion according to the embodiment 8 of the present invention.
Figure 12:
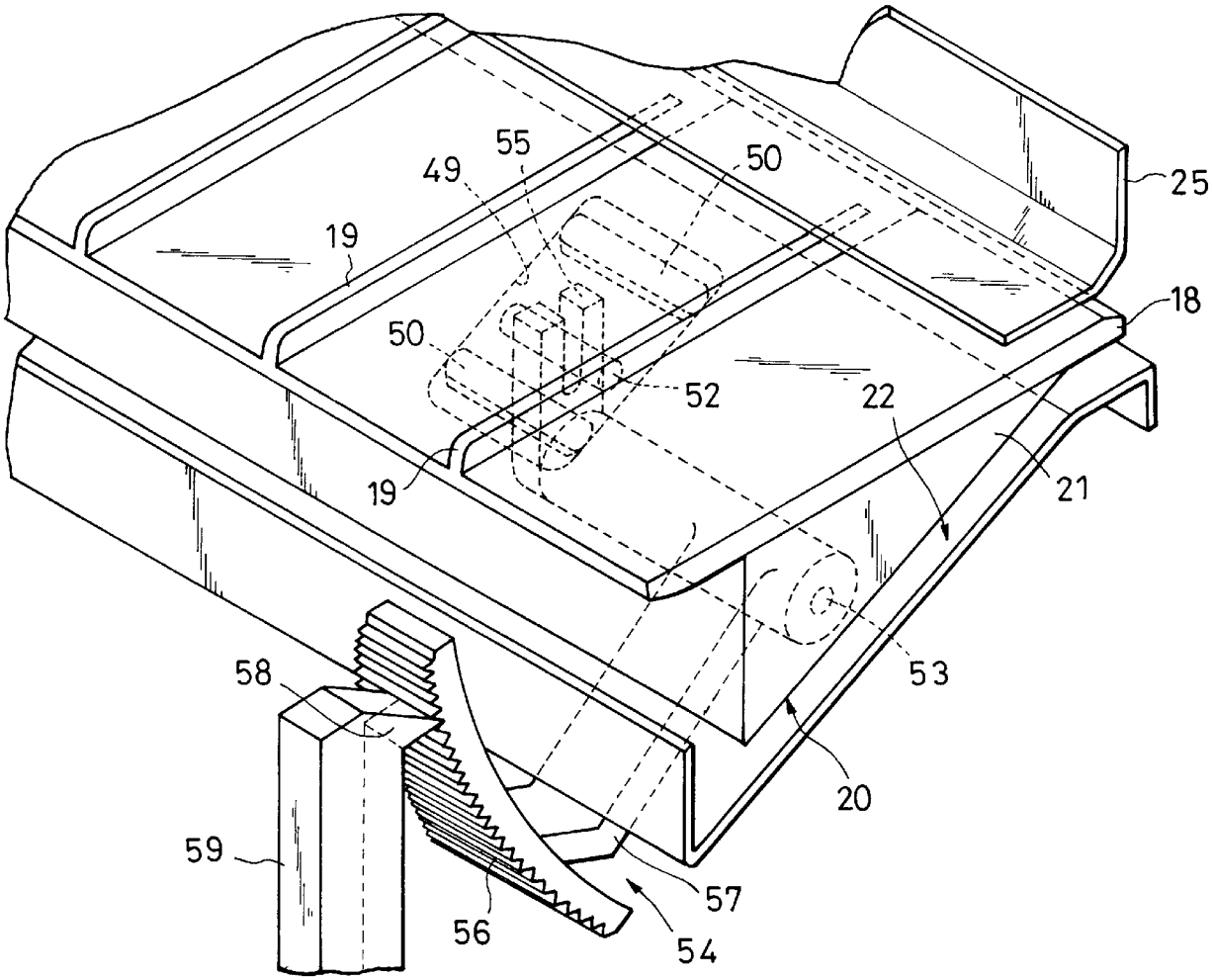
FIG. 12 is a diagrammatic perspective view showing the construction of the major portion according to the embodiment 8 of the present invention.

FIGS. 9 and 10 are diagrammatic cross-sectional views showing the construction of the major portion of an embodiment 8 of the present invention. FIG. 11 is the fragmentary external perspective view of the major portion of the embodiment 8, and FIG. 12 is the diagrammatic perspective view showing the construction of the major portion of the embodiment 8 with parts shown in phantom. In these figures, components equivalent or identical to those described in connection with the preceding embodiments are designated with the same reference numerals, and their description is not repeated.

The inclined guide surface 22 of the platen support plate 23 has a slot 49 that in the direction of sliding of the movable guide plate 21. A pair of projections 50 that are slidably engaged with the slot 49 are projected from the inclined surface 20 of the movable guide plate 21. Consideration in given to reducing play of the movable guide plate 21 in the direction of width of the printing medium 13 with respect to the platen support plate 23 and enabling smooth sliding of the able guide plate 21 along the platen support plate 23. The inclined guide surface 20 is provided with a recess 51 between the projections 50. Accommodated in the recess 51 is a locking pin 52 integrally formed of the platen support plate 23 and extending in the direction of width of the printing medium 13.

Disposed below the platen support plate 23 is a rotatable pivot shaft 53 extending in the direction of width of the printing medium 13. The pivot shaft 53 is integrally connected to a pivot lever 54 having a bell-crank configuration one and of the pivot lever 54 terminates in a bifurcated fork portion 55 that is inserted into the recess 51 and engaged with the locking pin 52. The other end of the pivot lever 54 terminates in an arm portion 57 that runs generally vertically in FIG. 9) along a semicircle cantered on the pivot shaft 53. The arm portion 57 has a number of serrated teeth 56.

When the forward edge of the printing medium 13 is brought into bete the platen 18 and the medium positioning plate 25, the plate 18 is pressed downward against the urging of the compression spring 24 in FIG. 9. The platen 18 and the lo pin 52 integrated with the movable guide plate 21 move downwardly rightward. As a result, the fork portion 55 of the pivot lever 54 engaged with the lock pin 52 is pivoted clockwise in FIG. 9 about the pivot shaft 53 along with the arm portion 57.

A latch lever 59 has, on its one end, a pawl 58 that is engaged with the teeth 56 of the pivot leer 54. The base of the latch lever 59 is pivotally supported about a lever shaft 60 that extends in parallel with the pivot shaft 53. The base of the latch lever 59 has a locking member 61 and a release lo 62, both diagonally oppositely projected thereacross. The locking member 61 is connected to a pulling spring 63 that urges the pawl 58 to engage with the teeth 56. In this embodiment, the teeth 56 generate, between their engagement face and the pawl 58, a force component that causes the latch lever 59 to pivot clockwise about the lever shaft 60 in FIG. 9 against the urging of the pulling spring 63, when the pivot lever 54 pivots clockwise about the pivot shaft 53 in FIG. 9. Furthermore, the teeth 56 are oriented such that the counterclockwise pivoting of the pivot lever 54 about the pivot shaft 53 is blocked in FIG. 9.

When the platen 18 is displaced away from the medium positioning plate 25, the engagement position of the teeth 56 with the pawl 58 is shifted accordingly. The shifted position of the platen 18 is thus automatically locked. To cause a slight displacement of the platen 18 to move the engagement position of the teeth 56 with the pawl 58, the arm portion 57 may be set to be 10 ti as long as the fork portion 55, for example. Assuming that a displacement of the movable guide plate 21 is 0.1 mm, the displacement of the teeth 56 relative to the pawl 58 is 1 mm. With the pitch of the teeth 56 being 1 mm or smaller, the displacement of the movable guide plate 21 as small as 0.1 mm is sufficient to shift the engagement position of the teeth 56 with the pawl 58.

Disposed beside the release lever 62 is a lever handling arm 65 attached to a release shaft 64. The release shaft 64 is connected to an unshown driving unit that drives the release shaft 64 intermittently. With the lever arm 65 faking a counterclockwise turn in FIG. 9, the release lever 62 is engaged with the lever handling arm 65, pivoting clockwise the latch lever 59 about the lever shaft 60. When the release lover 62 is disengaged with the lover handling arm 65, the latch lever 59 returns to the state shown in FIG. 9 by the urging of the pulling spring 63.

A full turn of the lever handling arm 65 pivots clockwise the latch lever 59 about the lever shaft 60 in FIG. 9. The pawl 58 is temporarily disengaged with the teeth 56. With no printing medium 13 interposed between the platen 18 and the mum positioning plate 25, the platen 18 is pushed upward by the urging of the compression spring 24 until it contacts the medium positioning plate 25.

The release shaft 64 may be allowed to rotate each time a sheet of printing medium 13 is printed. However, it in advantageous to rotate the release shaft 64 each time the thickness of the printing medium 13 is changed or each time a single session of printing is completed.

When the forward edge of the printing medium 13 is brought into between the platen 18 and the medium positioning plate 25, and when the platen 18 and the movable guide plate 21 are retracted away from the medium positioning plate 25 and in the direction of the advance of the printing medium 13, in accordance with the thickness of the printing medium 13, the engagement position of the teeth 56 with the pawl 58 of the latch lever 59 is automatically shifted in accordance with the amount of retraction, and thus the spacing between the platen 18 and the medium positioning plate 25 is kept to the clearance corresponding to the thickness of the printing medium 13. As shown in FIG. 10, therefore, even when the backward edge of the printing medium 13 advances past the platen 18 and the medium positioning plate 25, the platen 18 remains in a retracted position unless the release shaft 64 is driven. The spacing between the ink-Jet print head 11 and the printing surface 28 of the printing medium 13 is maintained appropriate. Thus, if the printing area of the printing medium 13 is widened, a good printing quality is maintained.

The embodiment 9 of the present invention is now discussed.

In the embodiment 8, the pivot lever 54 may be employed. Alternatively, the pivot lever 54 is dispensed with.

Figure 13:
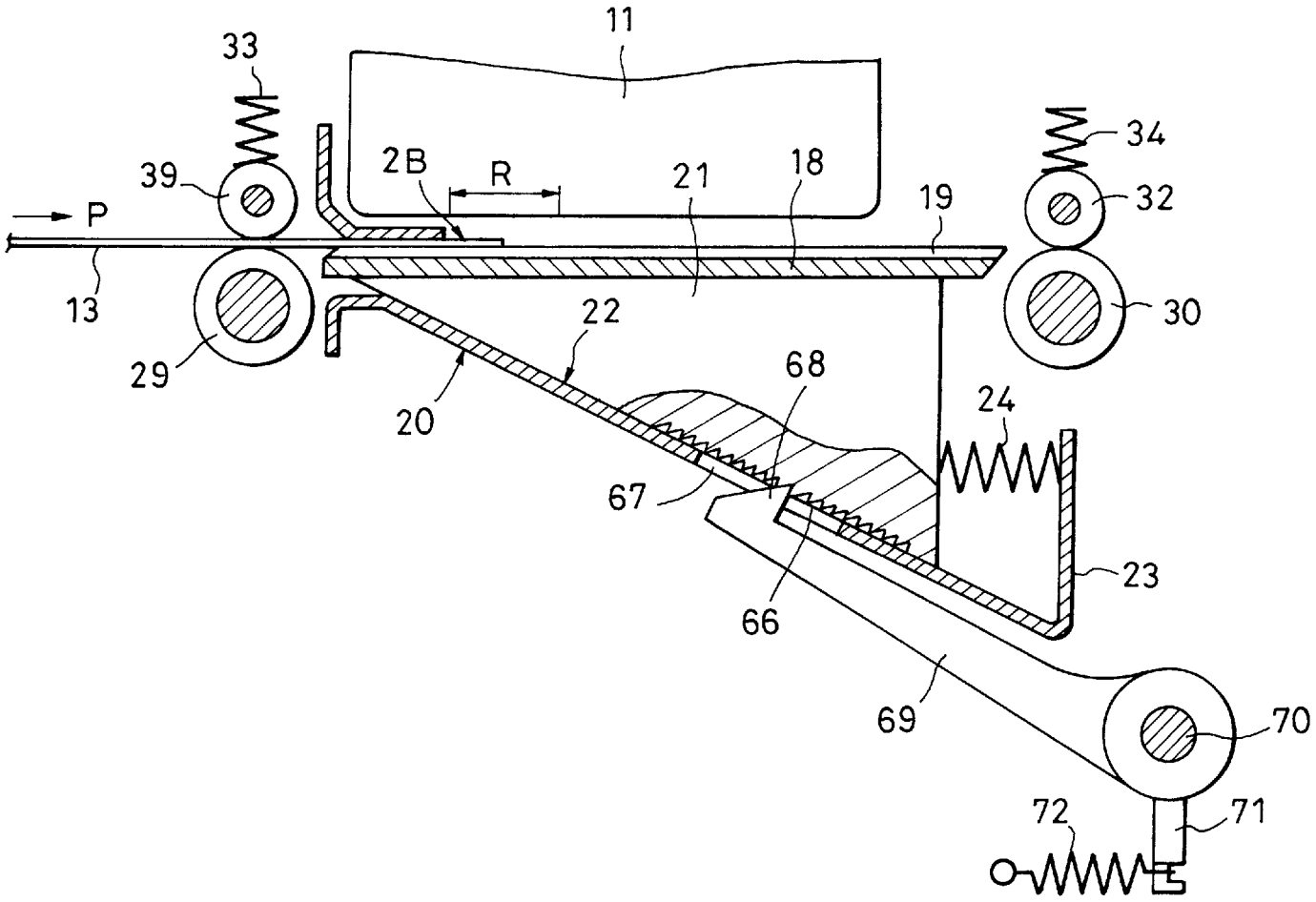
FIG. 13 is a diagrammatic cross-sectional view showing the construction of the major portion of an embodiment 9 of the present invention.
Figure 14:
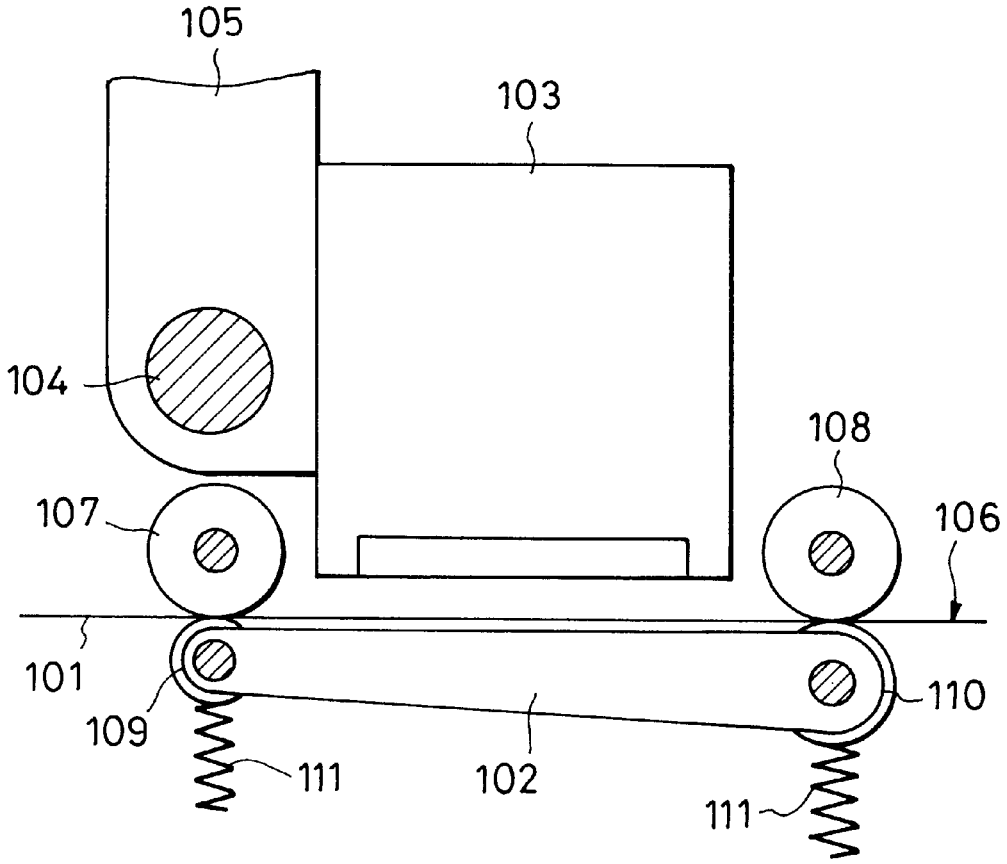
FIG. 14 is the diagrammatic cross-sectional view showing the construction of the major portion of a known printing apparatus.

Such an ink-jet printing apparatus is shown in the diagrammatic cross-sectional view in FIG. 13 as the embodiment 9 of the present invention. In FIG. 13, components equivalent or identical to those described in connection with the preceding embodiments are designated with the same reference numerals, and their description is not repeated.

The inclined guide surface 20 of the movable guide plate 21 has a number of serrated teeth 66 along the direction of move of the movable guide plate 21. The inclined guide surface 22 of the platen support plate 23 has an op 67 facing the teeth 66. A latch lever 69 has on its one end a pawl 68 that is engaged with the teeth 66 through the opening 67. The base of the latch lever 69 is pivotally supported about a lever shaft 70. A locking Doer 71 is projected from the base of the latch 1 69. The locking m r 71 is loaded with a pulling spring 72 that urge the pawl 68 of the latch lever 69 to the teeth 66 of the movable guide plate 21.

The teeth 66 generate, between their engagement face and the pawl 68, a force component that causes the latch lever 69 to pivot counterclockwise about the lever shaft 70 in FIG. 13 against the urging of the pulling spring 72, when the platen 18 and the movable guide plate 21 move downwardly rightward along the platen support plate 23 in FIG. 13. Furthermore, the teeth 66 are oriented such that the upwardly leftward movement of the platen 18 and the movable guide plate 21 along the inclined guide surface 22 of the platen support plate 23 is blocked.

When the platen 18 Is displaced away from the medium positioning plate 25, engagement position of the teeth 66 with the pawl 68 is shifted accordingly. The shifted position of the platen 18 is thus automatically locked. This arrangement offers the am advantage as the preceding embodiment shown in FIGS. 9 through 12.

In the above embodiment, the Unix for releasing the pawl 68 of the latch lever 69 from the teeth 66, namely the mechanism corresponding to the release lever 62, the release shaft 64, and the lever handling arm 65 in preceding embodiments, is not shown. A mechanism similar to these may be employed. In embodiment 7 and 8, teeth 56, 66 and pawls 58, 68 are employed. Another alternative clutch mechanism may be used.

Instead of the print head 11, all above embodiments may use an optical pickup head mounted on the carriage 12 for reading a document rather than printing a printing medium. In this case, the apparatus works as a document reader with the same advantage described above retained.

According to each of the above embodiments, the spacing between the printing surface of the printing medium of an arbitrary thickness and the print head is maintained appropriate.

When a pair of transport rollers for advancing a printing medium are designed to work as a medium positioning member<as well, the component count of the apparatus is reduced with a compact design implemented.

When a transport mechanism is constructed of a pair of transport rollers in contact with the back surface of the printing medium opposite the printing Surface for advancing the printing medium, and a pair of pinch rollers in contact with the printing surface of the printing medium, with the transport rollers engage with the-pinch rollers with the printing medium therebetween, the transport rollers are put into contact with the printing medium over its entire width. Thus, the apparatus enjoys an improved advance accuracy of the printing medium.

When the forward edge of the printing medium is brought into between the platen and the medium positioning member, the platen is temporarily retracted from the medium positioning member by the platen retraction means. A printing medium, if thin and limp, is free from jamming.

When the apparatus further comprises platen engaging means for holding the platen to a medium positioning means with the spacing kept therebetween corresponding to the thickness of a printing medium against the urging of a platen urging member and engagement releasing means for releasing the platen out of the platen engaging means, the spacing between the medium positioning member and the platen is automatically kept in accordance with the thickness of the printing medium. Even after the backward edge of the printing medium advance past the nip between the medium positioning member the platen, the spacing bet the print head and the printing surface of the printing medium remains unchanged. Thus, high quality printing is perform over a wide ax on the printing surface of the printing medium.

What is claimed is:

1. A printing apparatus for printing on a printing surface of a printing medium placed in a printing position with a print head, said apparatus comprising:

a platen displaceably mounted in positions facing the print head, for supporting the printing medium from a back surface of the printing medium opposite the printing surface;

a transport mechanism for advancing the printing medium to the printing position on the platen adjacent the print head and for delivering the printing medium out of the printing position;

a medium positioning member disposed upstream of the printing position in a direction of advance of the printing medium such that the medium positioning member contacts the printing surface of the printing medium;

a support mechanism for supporting the platen so that the platen is moved in parallel displacement along a displacement path, the displacement path moving in a direction downstream along the direction of advance of the printing medium and in a direction that the platen parts from the print head; and an urging member for urging the platen in a direction opposite to the direction of displacement of the platen displaced by the support mechanism, to press the platen against the medium positioning member.

2. The printing apparatus according to claim 1, wherein the support mechanism comprises a platen sliding inclined surface that allows the platen to part away from the print head as the platen moves downstream in the direction of advance of the printing medium.

3. The printing apparatus according to claim 1, further comprising a platen retraction mechanism for retracting the platen against the urging of the urging member in the direction that the platen parts from the medium positioning member.

4. The printing apparatus according to claim 3, wherein the platen retraction mechanism retracts the platen in the direction that the platen parts from the medium positioning member before the forward edge of the printing medium is advanced into a position between the medium positioning member and the platen.

5. The printing apparatus according to claim 4, wherein the medium positioning comprises plural members which are arranged respectively upstream of and downstream of the printing position along the direction of advance of the printing medium.

6. The printing apparatus according to claim 1, further comprising plate engaging for holding the platen to the medium positioning member with a spacing kept therebetween corresponding to the thickness of the printing medium against the urging of the platen urging member and engagement releasing means for releasing the platen out of engagement with the platen engaging means.

7. The printing apparatus according to claim 6, wherein the platen engaging means holds a platen at the position where the platen has been shifted in the direction away from the medium positioning member.

8. The printing apparatus according to claim 7, wherein the medium positioning member comprises plural members which are arranged respectively upstream of and downstream of the printing position along the direction of advance of the printing medium.

9. The printing apparatus according to any one of claims 1 through 8, wherein the print head comprises an ink-jet print head that ejects ink through a nozzle.

10. The printing apparatus according to claim 9, wherein the ink-jet print head comprises an electrothermal converter element for generating energy to eject the ink.

11. A printing method for maintaining at a predetermined distance spacing between a printing surface of a printing medium placed in a printing position and a print head, said method comprising the steps of:

providing a print head and a platen displaceable in a displacement path having one component in a direction of advance of the printing medium and another component in a direction that the platen parts from the print head; and displacing the platen along the displacement path while maintaining the position of the printing surface at the printing position and pressing the platen from below the printing medium opposite the printing surface, to maintain the predetermined distance of the spacing between the printing surface of the printing medium and the print head regardless of a change in thickness of the printing medium.

12. The printing method according to claim 11, wherein the displacing step comprises sliding the platen along an inclined surface against urging of an urging member along the displacement path.

13. The printing method according to any of claims 11 and 12, wherein the print head comprises an ink-jet print head that ejects ink through a nozzle.

14. The printing method according to claim 13, wherein the ink-jet print head comprises an electrothermal converter element for generating energy to eject the ink.

* * * * *

UNITED STATES PATENT AND TRADEMARK OFFICE

CERTIFICATE OF CORRECTION

PATENT NO. : 5,940,092

DATED : August 17, 1999

INVENTOR(S): MAKOTO KASHIMURA, ET AL.

It is certified that error appears in the above-identified patent and that said Letters Patent is hereby corrected as shown below:

COVER PAGE AT ITEM [30],
Foreign Application Priority Data: "4-339293" should read --7-339293--.

COLUMN 1,
Line 21, "The-printing" should read --The printing--; and
Line 24, "hand" should read --head--.

COLUMN 2,
Line 8, "rotatable" should read --rotatably--;
Line 56, "area inevitably bulky" should be deleted; and
Line 57, "area." should read --area inevitably bulky.--.

COLUMN 4,
Line 23, "shoving" should read --showing--; and
Line 42, "ha" should read --has--.

COLUMN 6,
Line 5, "is" should be deleted.

COLUMN 7,
Line 5, "ths" should read --this--;
Line 8, "ford" should read --forward--;
Line 10, "bet" should read --between--;

UNITED STATES PATENT AND TRADEMARK OFFICE

CERTIFICATE OF CORRECTION

PATENT NO. : 5,940,092

DATED : August 17, 1999

INVENTOR(S): MAKOTO KASHIMURA, ET AL.

It is certified that error appears in the above-identified patent and that said Letters Patent is hereby corrected as shown below:

COLUMN 7

Line 15, "Arable" should read --movable--;
Line 33, "diagru-" should read --diagramm- --;
Line 37, "ref e" should read --reference--;
Line 53, "between-the" should read --between the--; and
Line 59, "26.is" should read --26 is--.

COLUMN 8,

Line 10, "Is" should read --is--;
Line 18, "Bus" should read --medium--;
Line 22, "deans an" should read --means and--;
Line 27, "refer" should read --reference--;
Line 35, "an" should read --in--;
Line 39, "prong" should read --printing--, and "therebtween." should read --therebetween.--;
Line 55, "projected-out" should read --projected out--; and
Line 61, "comports" should read --components--, and "pelt" should read --permit--.

COLUMN 9,

Line 2, "mum" should read --medium--;
Line 3, "urging" should read --urging of--;
Line 11, "is" should be deleted;

UNITED STATES PATENT AND TRADEMARK OFFICE

CERTIFICATE OF CORRECTION

PATENT NO. : 5,940,092

DATED : August 17, 1999

INVENTOR(S): MAKOTO KASHIMURA, ET AL.

It is certified that error appears in the above-identified patent and that said Letters Patent is hereby corrected as shown below:

COLUMN 9

Line 19, "he" should read --The--;
Line 25, "conned" should read --connected--, and "Or" should read --manner--; and
Line 40, "in" should read --is--.

COLUMN 10,

Line 7, "I8" should read --18--;
Line 12, "AS" should read --As;
Line 20, "ink-Jet" should read --ink-jet--;
Line 28, "a e" should read --arranged--;
Line 29, "mm" should read --move--;
Line 50, "that" should read --that extends--;
Line 54, "in" should read --is--; and
Line 67, "configuration" should read --configuration.--.

COLUMN 11,

Line 1, "one and" should read --One end --
Line 5, "cantered" should read --centered--;
Line 8, "bete" should read --between--;
Line 11, "lo" should read --locking--;
Line 16, "leer 54." should read --lever 54.--;

UNITED STATES PATENT AND TRADEMARK OFFICE

CERTIFICATE OF CORRECTION

PATENT NO. : 5,940,092

DATED : August 17, 1999

INVENTOR(S): MAKOTO KASHIMURA, ET AL.

It is certified that error appears in the above-identified patent and that said Letters Patent is hereby corrected as shown below:

COLUMN 11

Line 20, "lo 62," should read --lever 62,--;
Line 37, "ti" should read --times--;
Line 46, "faking" should read --making--;
Line 50, "lover" should read --lever--;
Line 57, "mum" should read --medium--; and
Line 61, "in" should read --is--.

COLUMN 12,

Line 13, "ink-Jet" should read --ink-jet--;
Line 15, "a" should be deleted;
Line 28, "move" should read --movement--;
Line 29, "op 67" should read --opening 67--;
Line 33, "Doer 71" should read --member 71--;
Line 34, "latch 169." should read --latch lever 69.--, and "m r 71" should read --member 71--;
Line 35, "urge" should read --urges--;
Line 45, "Is" should read --is--;
Line 49, "am" should read --same--;
Line 51, "Unix" should read --mechanisms--; and
Line 63, "advantage" should read --advantages--.

UNITED STATES PATENT AND TRADEMARK OFFICE

CERTIFICATE OF CORRECTION

PATENT NO. : 5,940,092

DATED : August 17, 1999

INVENTOR(S): MAKOTO KASHIMURA, ET AL.

It is certified that error appears in the above-identified patent and that said Letters Patent is hereby corrected as shown below:

COLUMN 13,
Line 3, "member<as" should read --member as--;
Line 7, "Surface" should read --surface--;
Line 10, "engage" should read --engaged--, and "the-pinch" should read --the pinch--;
Line 28, "advance" should read --advances--;
Line 29, "member" should read --member and--, and "bet" should read --between--;
Line 31, "perform" should read --performed--; and
Line 32, "ax" should read --area--.

COLUMN 14,
Line 13, "positioning" should read --positioning member--;
Line 18, "plate engaging" should read --platen engaging means--; and
Line 24, "a platen at the" should read --the platen at a--.

Signed and Sealed this

Second Day of May, 2000

*Attest:*

Q. TODD DICKINSON

*Attesting Officer*

*Director of Patents and Trademarks*